United States Patent [19]

Szecket

[11] Patent Number: 4,842,182

[45] Date of Patent: Jun. 27, 1989

[54] IMPACT WELDING

[75] Inventor: Alexander Szecket, 24 Codsell Avenue, Downsview, Ontario, Canada, M3H 3V5

[73] Assignees: Alfredo Bentivoglio; Richardo Rodriquez, both of Mississagua, Canada; Alexander Szecket, Alburqerque, N. Mex.

[21] Appl. No.: 154,272

[22] Filed: Feb. 10, 1988

Related U.S. Application Data

[62] Division of Ser. No. 710,433, Mar. 11, 1985, Pat. No. 4,747,350.

[30] Foreign Application Priority Data

Jun. 18, 1984 [CA] Canada ..... 456836

[51] Int. Cl.[4] ..... B23K 20/08

[52] U.S. Cl. ..... 228/108; 228/109

[58] Field of Search ..... 228/107-109

[56] References Cited

U.S. PATENT DOCUMENTS

| | | | |
|---|---|---|---|
| 3,233,312 | 2/1966 | Cowan et al. | 228/109 |
| 3,377,693 | 4/1968 | Fukumoto | 228/109 |
| 3,397,444 | 8/1968 | Bergmann et al. | 228/108 |

OTHER PUBLICATIONS

A. Szecket, "An Experimental Study of the Explosive Welding Window Using a Gas-Gun", [thesis for PH.D].
Queen's University of Belfast, May 1979, Chapters 6-7 and Summary page.

B. Crossland, *Explosive Welding of Metals and Its Application,* Claringdon Press, Oxford, 1982, Chapter 5.

B. Crossland, *Explosive Welding of Tubes to Tube Plates,* Proceding 2nd Int'l. Conf. "Pressure Vessel Technology", Oct. 1-14, 1973, pp. 1131-1149.

*Primary Examiner*—Nicholas P. Godici
*Assistant Examiner*—Carmine Cuda
*Attorney, Agent, or Firm*—Eugene J. A. Gierczak

[57] ABSTRACT

An improved process for metallugically bonding two layers of metal capable of forming brittle intermetallics, by means of propelling one of the layers progressively into collision along the other layer at a velocity and impact angle selected to produce a substantially straight bond along a common interfacial region of contact between the layers; and includes the welded product formed thereby.

18 Claims, 9 Drawing Sheets

THE WELDING WINDOW IN THE Vw/b PLANE

| | ZINC | PALLADIUM ALLOY | TD NICKEL | TUNGSTEN | NICHROME | MAGNESIUM | MOLYBDENUM | COLUMBIUM and ALLOYS | PLATINUM | SILVER and Ag ALLOYS | GOLD ALLOYS | TANTALUM | HAYNES STELLITE ALLOY 6B (c) | HASTELLOY ALLOY X (c) | B.C.F. (c) | ZIRCONIUM and ZIRCALLOYS | TITANIUM and TI ALLOYS 6Al-4V | NICKEL and Ni ALLOYS (b) | BRONZE | CUPRO-NICKEL | BRASS | COPPER | ALUMINUM and Al ALLOYS | MARAGING STEEL | HANDFIELD STEEL | STAINLESS STEEL 200 Srs | 300 Srs | FERRITIC | ALLOY STEEL, AISI 4320 | 4130 | LOW ALLOY STEEL, ASTM A-387 | A-302 | A-204 | MED C STEEL, ASTM A-212 | A-201 | A-285 | LOW C STEEL AISI 1004-1020 |
|---|---|---|---|---|---|---|---|---|---|---|---|---|---|---|---|---|---|---|---|---|---|---|---|---|---|---|---|---|---|---|---|---|---|---|---|---|---|
| LOW C STEEL, AISI 1004-1020 | X | | | | | X | X | | | X | | X | | | | | | X | | X | X | X | X | | | X | X | X | | | | | | | | | X |
| MED C STEEL, ASTM A-285 | | | | | | X | X | | | X | | X | X | X | X | X | X | X | X | X | X | X | X | | | X | X | X | | | | | | | | X | |
| A-201 | | | | | | X | X | X | | X | | X | X | X | X | X | X | X | X | X | X | X | X | | | X | X | | | | | | | | X | | |
| A-212 | | | | | | X | X | X | | X | | X | X | X | X | X | X | X | X | X | X | X | X | | | X | X | | | | | | | X | | | |
| LOW ALLOY STEEL, ASTM A-204 | | | | | | | | | | | | | | X | X | X | X | X | | X | X | X | X | | | X | X | | | | | | X | | | | |
| A-302 | | | | | | | | | | | | | | X | X | | X | X | | X | X | X | X | | | X | X | | | | | X | | | | | |
| A-387 | | | | | | | | | | | | | | X | X | | X | X | | | | | X | | | X | X | X | | | X | | | | | | |
| ALLOY STEEL, AISI 4130 | | | | | | | | | | | | | | | | | | | | | | | | | | | X | | | X | | | | | | | |
| 4340 | | | | | | | | | | | | | | | | | | | | | | | | | | | X | | X | | | | | | | | |
| STAINLESS STEEL, FERRITIC | | | | | | | | | | | | | | | | | X | | | | | | | | | | X | X | | | | | | | | | |
| 300 Srs. | | | X | | | | X | X | | | | | X | | | | X | X | | | X | X | X | X | | | X | | | | | | | | | | |
| 200 Srs. | | | | | | | | | | | | | | | | | | | | | X | | X | | | X | | | | | | | | | | | |
| HADFIELD STEEL | | | | | | | | | | | | | | | | | | | | | | | | | X | | | | | | | | | | | | |
| MARAGING STEEL | | | | | | | | | | | | | | | | | | | | | | | X | | | | | | | | | | | | | | |
| ALUMINUM and Al ALLOYS | | | | | | | | | | | | | | | | | X | | | | | X | X | | | | | | | | | | | | | | |
| COPPER | | | | | | | X | | | | | X | | | | | X | | | | | X | | | | | | | | | | | | | | | |
| BRASS | | | | | | | | | | | | | | | | | | X | | | X | | | | | | | | | | | | | | | | |
| CUPRO-NICKEL | | | | | | | | | | | | | | | | | | | | X | | | | | | | | | | | | | | | | | |
| BRONZE | | | | | | | | | | | | | | | | | | | X | | | | | | | | | | | | | | | | | | |
| NICKEL and Ni ALLOYS (b) | | | | | | | | | X | | X | | | X | | | X | X | | | | | | | | | | | | | | | | | | | |
| TITANIUM and Ti ALLOYS 6Al-4V | | | | X | | | | X | | | | | | | | | X | | | | | | | | | | | | | | | | | | | | |
| ZIRCONIUM and ZIRCALLOYS | | | | | | | | | | | | | | | | X | | | | | | | | | | | | | | | | | | | | | |
| HASTELLOY ALLOYS B.C.F. (c) | | | | | | | | | | | | | | | X | | | | | | | | | | | | | | | | | | | | | | |
| X (c) | | | X | | | | | | | | | | | X | | | | | | | | | | | | | | | | | | | | | | | |
| HAYNES STELLITE ALLOY 6B (c) | | | | | | | | | | | | X | | | | | | | | | | | | | | | | | | | | | | | | | |
| TANTALUM | | | | | | | | | | | X | | | | | | | | | | | | | | | | | | | | | | | | | | |
| GOLD ALLOYS | | | | | | | | | | X | | | | | | | | | | | | | | | | | | | | | | | | | | | |
| SILVER and Ag ALLOYS | | | | | | | | | X | | | | | | | | | | | | | | | | | | | | | | | | | | | | |
| PLATINUM | | | | | | | | X | | | | | | | | | | | | | | | | | | | | | | | | | | | | | |
| COLUMBIUM and ALLOYS | | X | | | | | X | X | | | | | | | | | | | | | | | | | | | | | | | | | | | | | |
| MOLYBDENUM | | | | X | | | X | | | | | | | | | | | | | | | | | | | | | | | | | | | | | | |
| MAGNESIUM | | | | | X | | | | | | | | | | | | | | | | | | | | | | | | | | | | | | | | |
| NICHROME | | | | X | | | | | | | | | | | | | | | | | | | | | | | | | | | | | | | | | |
| TUNGSTEN | | | X | | | | | | | | | | | | | | | | | | | | | | | | | | | | | | | | | | |
| TD NICKEL | | X | | | | | | | | | | | | | | | | | | | | | | | | | | | | | | | | | | | |
| PALLADIUM ALLOY | | | | | | | | | | | | | | | | | | | | | | | | | | | | | | | | | | | | | |
| ZINC | X | | | | | | | | | | | | | | | | | | | | | | | | | | | | | | | | | | | | |

NOTES (a) A BLANK SPACE MEANS BONDING OF THAT CONDITION HAS NOT BEEN ATTEMPTED. IT DOES NOT MEAN THOSE METALS CANNOT BE EXPLOSION BONDED.

(b) INCLUDES INCANEL, MONEL* AND INCALLOY.* * REGISTERED TRADE MARK OF INTERNATIONAL NICKEL COMPANY.

(c) REGISTERED TRADE MARK OF UNION CARBIDE CORP.

METAL COMBINATIONS BONDED BY EXPOSIVE CLADDING

Figure 27

IMPACT WELDING

This is a division of application Ser. No. 710,433, filed Mar. 11, 1985, now U.S. Pat. No. 4,747,350.

FIELD OF INVENTION

This invention relates to an improved method for the metallurgical bonding of metals capable of forming brittle intermetallics by propelling one layer progressively into collision along another layer and particularly relates to the application of explosion welding procedures for welding layers of metal which form brittle intermetallics.

More particularly, this invention relates to the fabrication of improved welded products, the bond being substantially free of intermetallics by utilizing the improved method for the metallurgical bonding of metals where brittle intermetallics could form.

BACKGROUND TO THE INVENTION

Solid phase welding is a method of welding metals by the application of pressure so as to produce interfacial plastic deformation of the metals at the interfacial surfaces which breaks up the contaminant surface films to expose virgin contact surfaces for bonding.

A solid phase weld may be achieved by a process identified as "impact welding" which consists of driving or propelling one metal layer against another metal layer at a sufficient velocity and at an oblique impact so as to cause bonding of the two metal layers together at the common interfacial region of contact. Impact Welding has been achieved by those skilled in the art by utilizing magnetic propulsion equipment, gas guns and explosives to propel the metal layers together. If the metals are driven together by means of explosion, the process is known as explosion welding.

In explosion welding, metal plates or layers which are to be welded are spaced apart relative to one another in either generally parallel relation or inclined relation, and a layer of suitable explosive charge disposed on one of the metal layers is detonated so as to impart kinetic energy to the "flyer" plate causing the flyer plate to collide obliquely with the stationary "parent" plate. The explosive while detonating produces a force normal to the flyer plate causing the flyer plate to impact the parent plate obliquely at a collision or impact angle. As the detonation proceeds along the flyer plate, it progressively drives the flyer plate along the parent plate at a particular welding velocity. If two metal layers are to be bonded the explosive charge may be disposed on both metal layers.

U.S. Pat. Nos. 3,728,780 and 3,137,937 generally relate to explosion welding, which may be utilized to weld different metals together.

U.S. Pat. No. 3,813,758 teaches that a metal jet is formed at the point of impact between the flyer plate and parent plate. It is believed that this jet which contains the contaminant surface layers of both plates is forced outwardly at a high velocity during the explosion welding process. This cleaning operation allows a solid phase weld to be formed between the interfacial virginally clean metallic surfaces of the plates under the intense local pressure in the region of contact.

U.S. Pat. No. 3,583,062 discloses that three types of bonded zones may result from explosion welding, namely:

(a) a direct metal to metal bond (with a straight interface);

(b) a uniform melted layer in which the metals are bonded together with an intervening layer of solidified melt substantially homogeneous composition;

(c) a wavy type of bond zone comprised of periodically spaced discreet regions of solidified melt, between areas of direct metal to metal bond.

Moreover, U.S. Pat. No. 3,397,444 generally teaches that products having the wavy type bond interface are preferred in many situations because of their normally higher strength, and defines values of parameters such as collision velocity so as to produce the preferred wavy interface.

Similarly, U.S. Pat. No. 3,583,062 states that the wavy bond zone is preferred over the substantially straight bond because of the larger interfacial area the wavy bond provides, and also defines the value of certain parameters which will produce the preferred wavy interface.

However for metal combinations tending to form brittle intermetallics, the melt associated with the bonded wavy interface presents zones of weakness. Metal combinations which tend to form brittle combinations are well known to those skilled in the art and generally encompass those metal combinations which have a wide dissimilarity between the densities of the metals to be bonded, which include for example, aluminum to steel, zirconium to steel, tantalum to steel, titanium to steel, titanium to copper, and their respective alloys.

Brittle intermetallics are diffusion products, and are undesirable, particularly when the welded zone is subjected to an increase in temperature which enhances diffusion.

Diffusion may be defined as a transfer of atoms into the vacancies and interstitial spaces from one metal to another; and diffusion is enhanced with an increase in temperature in the region of interfacial contact. In particular diffusion is enhanced in the region of pockets of melt associated with the bonded wavy interface as, during the welding process, these regions are subjected to elevated temperatures, due to the adiabatic rise of same at the vortex of each wave. Moreover, for the wavy morphology to occur, the entire interface has to be subjected to a higher energy than that necessary for a straight interface which will consequently produce larger plastic deformation and hence higher temperatures, further enhancing diffusion.

Furthermore, mechanical solicitation (such as dynamic or static bending) applied to a wavy interface causes the weld to fail in metal combinations capable of forming brittle intermetallics, as the interfacial pockets of melt create zones of weakness.

Efforts have been made to retard the diffusion process in the bonded zone particularly for those metal combinations capable of forming brittle intermetallics and particularly when such metal combinations are exposed to an elevated temperature, by utilizing diffusion barriers. In the case of aluminum to steel such barriers are titanium, nickel, chromium, molibdenum, silver, etc., or ferritic stainless steel as disclosed in Canadian Patent No. 917,869, which are sandwiched between and metallurgically bonded between the flyer and parent plate. However, the use of such barriers increases the cost of the explosion welded product, and their efficiency is quite relative.

OBJECTS OF THE INVENTION

The principle object of this invention is to provide improvements in metallurgically bonding metal layers capable of forming brittle intermetallics wherein the metal layers are driven together for solid phase welding in the region of interfacial contact so as to produce welds having superior strength characteristics.

More particularly, it is an object to provide an improved method for welding metals by impact welding and explosion welding.

A further important object resides in providing an improved welded product without the need of diffusion barrier interlayers.

SUMMARY OF INVENTION

In accordance with one aspect of this invention there is provided a process for metallurgically bonding at least two layers of metal capable of forming brittle intermetallics, by propelling one of the layers progressively into collision along the other layers at a velocity and impact angle selected to produce a substantially straight bond along a common interfacial region of contact between the layers. The metal layers may be selected from the group comprising steel, stainless steel, aluminum, copper, tantalum, nickel, titanium, zirconium, gold, silver, platinum, columbium, molybdenum, magnesium, chromium, tungsten, palladium, zinc and their respective alloys.

Another aspect of this invention resides in a method of welding at least two metal layers together along a common interfacial region of contact wherein the metal layers are characterized as capable of forming brittle intermetallics, by positioning the layers in generally spaced apart relation, applying a layer of explosive charge along the outer surface of one or both of the layers remote from the other layer, and detonating the explosive charge so as to weld the plates together, the improvement which comprises, selecting both the strength of explosive charge and the spacing between the layers so as to propel one of the layers progressively into collision along the other layer at a velocity and impact angle selected to produce a substantially straight interfacial metallurgical bond. A layer of protective material or buffer may be applied to the outer surfaces of one of the layers remote from the other layer and then applying the layer of explosive charge upon the buffer. In one embodiment, the layers are positioned generally parallel to one another while in another embodiment the layers are positioned in inclined relation to one another.

Still more particularly, it is an aspect of this invention to provide a method for metallurgically bonding two metal layers along a common interfacial region of contact, wherein the metal layers are characterized as capable of forming brittle intermetallics the method comprising positioning the layers in generally spaced apart parallel relation, applying a protective material adjacent the outer surface of one or both of the layers remote from the other layer, applying a layer of explosive charge upon the protective material, and detonating the explosive charge so as to produce a welded bond, the improvement which comprises selecting both the strength of explosive charge and the spacing between the layers so as to propel one of the layers progressively into collision along the other layer at a velocity and impact angle selected to produce laminar flow of the metal layers at the interface during detonation of the explosive charge and produce a welded bond having a substantially straight interfacial bond between said layers.

Yet another aspect of this invention resides in a method of producing bonded metal layers capable of developing brittle intermetallics and having improved strength characteristics in spite of prolonged exposure to elevated temperatures, by propelling one of the layers against the other to obliquely impact the layers together at a velocity and impact angle selected to produce a substantially straight interfacial bond between the layers.

Another aspect of this invention resides in a welded product comprising two metal layers capable of forming brittle intermetallics, wherein the metal layers are metallurgically bonded by propelling the layers together, and having a substantially straight interfacial bond along a common interfacial region of contact.

A further aspect of this invention lies in a welded product comprising two metal layers capable of forming brittle intermetallics which have been metalurgically bonded by propelling the layers together, and having a substantially straight interfacial bond with substantially no intermetallics along a common interfacial region of contact.

DRAWINGS

FIG. 27 is a tabulation of metals which are presently known to be capable of being bonded by explosion.

DESCRIPTION OF INVENTION

Explosion Welding

Throughout the figures identical parts have been given identical numbers.

Figure 1:
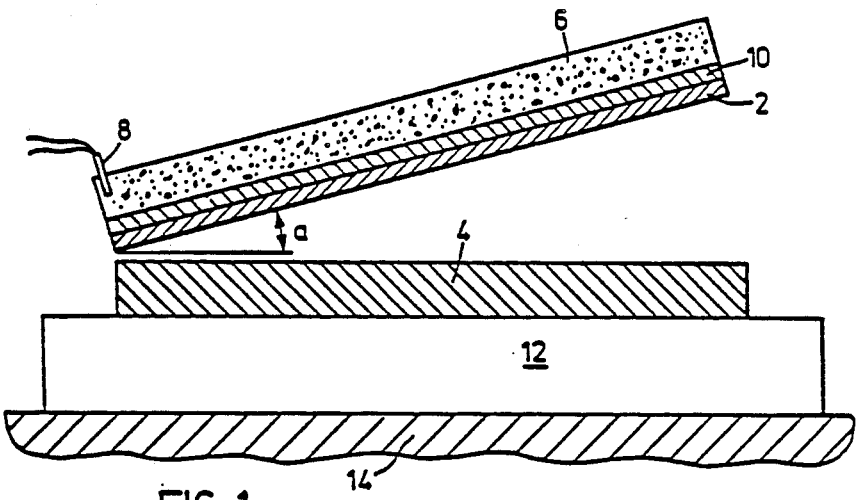
FIG. 1 is a side elevational view in section of the inclined arrangement for explosion welding.

FIG. 1 illustrates the inclined arrangement of explosion welding with the flyer plate 2 at an initial preset angle a between the flyer plate 2 and the parent plate 4, which arrangement is usually adopted when using a high detonation velocity explosive and/or small plates.

Figure 4:
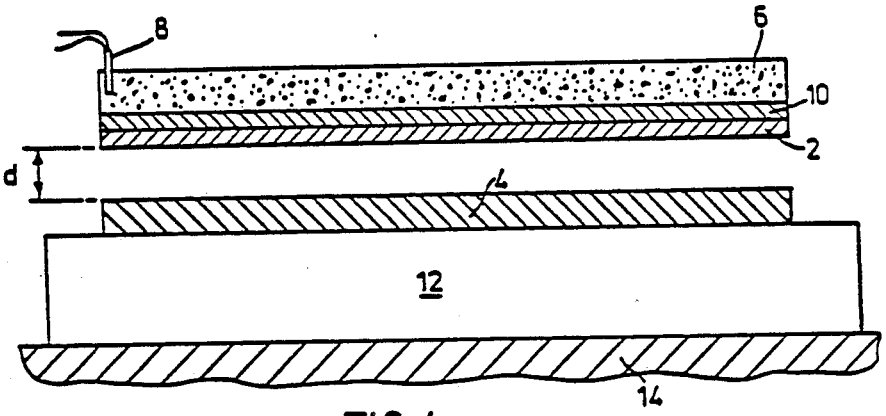
FIG. 4 is a side elevational view in section of the parallel arrangement for explosion bonding.

FIG. 4 shows the parallel arrangement of explosion welding where the flyer plate 2 is initially positioned substantially parallel to and spaced apart from the parent plate 4 by a uniform stand-off d and which arrangement is usually adopted when using a low detonation velocity explosive and/or large plates.

For both the inclined arrangement illustrated in FIG. 1 and the parallel arrangement illustrated in FIG. 4 a uniform layer of explosive charge 6 covering the flyer plate 2 is detonated by the detonator 8 in a manner well known to those skilled in the art. A protective material or buffer 10, such as rubber, polythene, cardboard or even a thick coat of plastic paint may be utilized to protect the top surface of the flyer plate 2 from damage. As can be observed from FIGS. 1 and 4 the parent plate 4 may rest on top of an anvil 12 to absorb the impact upon detonation of the explosive charge. The anvil 12 rests over a surface 14.

Figure 2:
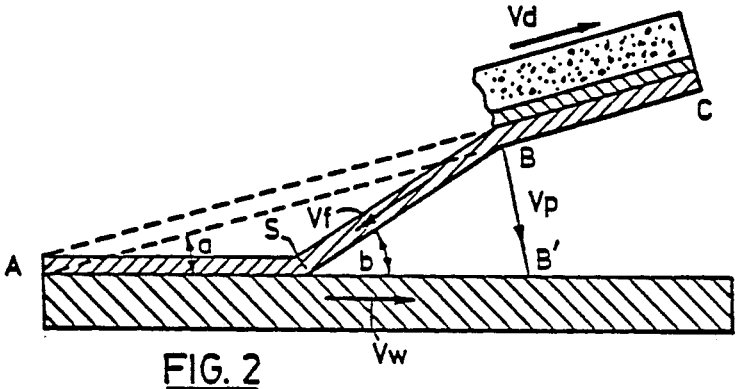
FIG. 2 is a side elevational view of the inclined arrangement for explosion welding illustrating bonding during detonation of explosive.
Figure 5:
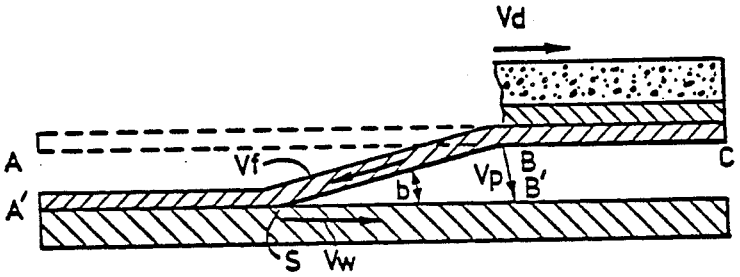
FIG. 5 is a side elevational view of the parallel arrangement for explosion welding illustrating bonding during detonation of explosive.

The explosive charge 6 is detonated by the detonator 8 to impart kinetic energy to the flyer plate 2 causing it to collide obliquely against the parent plate 4 at a collision point S illustrated in FIG. 2 for the inclined arrangement and FIG. 5 in the parallel arrangement.

The explosive charge 6 when detonated produces a pressure normal to the flyer plate imparting to it a velocity Vp illustrated in FIGS. 2 and 5 respectively.

The detonation of the explosive charge 6 proceeds along the flyer plate 2 at a velocity Vd illustrated in FIGS. 2 and 5 respectively and drives the flyer plate 2 progressively into collision with the parent plate 4. Under these conditions, the collision point S travels along the parent plate at a velocity herein referred to as welding velocity Vw illustrated in FIGS. 2 and 5 respectively.

In the parallel arrangement shown in FIG. 5, the welding velocity Vw is equal to the detonation velocity Vd, and the flyer plate 2 impacts the parent plate 4 obliquely at a collision angle b.

Relative to the collision point S, the flyer plate 2 appears to be moving with a velocity Vf towards the collision point S.

Figure 3:
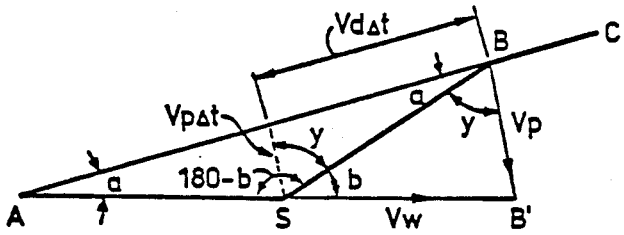
FIG. 3 is a diagram illustrating the trigonometric relationships of FIG. 2.
Figure 6:
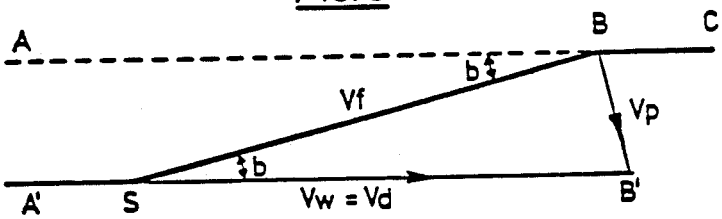
FIG. 6 is a diagram showing the trigonometric relationships of FIG. 5.

FIGS. 3 and 6 illustrate the geometric configuration of the process variables describing the inclined and parallel arrangements respectively for welding metal plates together by explosion.

From FIG. 3, the trigonometrical relationship between the detonation velocity Vd and the welding velocity Vw is obtained from triangle ASB as:

$$Vw = Vd \frac{\sin (b - a)}{\sin b} \tag{1.1}$$

Formula 1.1 is independent of the direction of the flyer plate impact velocity Vp and cannot be solved as it contains two unknowns b and Vw. The relationship between Vp, Vd and b which involves only one unknown b depends on the assumption regarding the direction of Vp. From FIG. 3, it is possible to deduce the following relationship:

$$Vp = Vd \sin (b-a) \sin y \tag{1.2}$$

Various boundry conditions have been tentatively assumed, none of which are entirely satisfactory but which all appear to lead to somewhat similar results for small collision angles b. Accordingly, equation (1.2) can be applied to the following 5 cases which, when solved, enable the solution for equation (1.1).

(a) The Normal To Vp Bisects a

This implies the flyer plate is stretched during the process but recovers afterwards in such a way that $AB = AB^1$. In this case:

$$Vp = Vd \frac{\sin (b - a)}{\cos (b - a/2)} \tag{1.3}$$

(b) The Normal To Vp Bisects b

The flyer plate's length after stretching remains unchanged such that $SB = SB^1$.

$$Vp = Vd \frac{\sin (b - a)}{\cos b/2} \tag{1.4}$$

(c) Direction of Vp Bisects SBC

If the direction of Vp bisects SBC then:

$$Vp = 2\ Vd \sin ((b-a)/2) \tag{1.5}$$

(d) Direction of Vp is Normal to $AB^1$ $$Vp = Vd \frac{\sin (b - a)}{\cos b} \tag{1.6}$$

(e) Direction of Vp is Normal to SB $$Vp = Vd \sin (b-a) \tag{1.7}$$

The above-identified equations were all derived from the inclined arrangement, but this does not effect the analysis for the parallel setup where a=o for equation (1.1) reduces to:

$$Vw=Vd \quad (1.8)$$

and equations (1.3) and (1.6) both reduce to:

$$Vp=Vw \tan b \quad (1.9)$$

and equations (1.4) and (1.5) reduce to:

$$Vp=2\ Vw \sin b/2 \quad (1.10)$$

and finally equation (1.7) reduces to:

$$Vp=Vw \sin b \quad (1.11)$$

The Jetting Phenomenon

Figure 7:
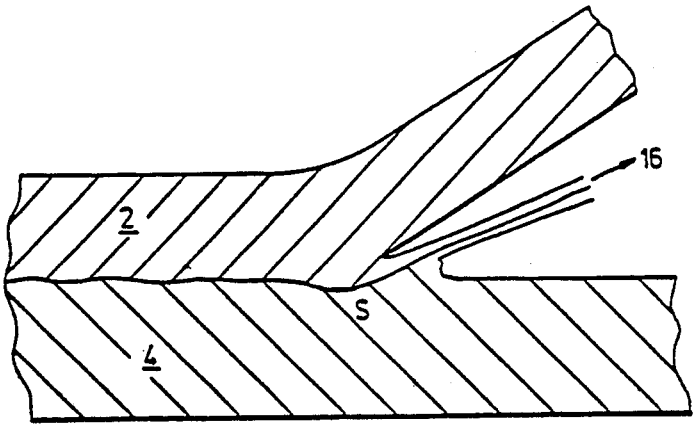
FIG. 7 is an illustration showing the jetting phenomenon during explosion welding.

It is believed that if the impact velocity Vp under oblique high velocity impact is sufficient and the collision angle b exceeds some minimum value, then a jet or spray 16 is formed at the collision point S as illustrated in FIG. 7. This jet 16 contains the contaminant surface layers of both plates 2 and 4 and is forced outwardly at a high velocity. Such removal of the contaminant surface layers allows a solid phase weld to be formed under the intense local pressure in the region of contact. This pressure is so great that the metal layers 2 and 4 in the region of collision behave for a short time as either nonviscous fluids or fluids of low viscosity.

The Explosion Bonded Interface

Figure 8:
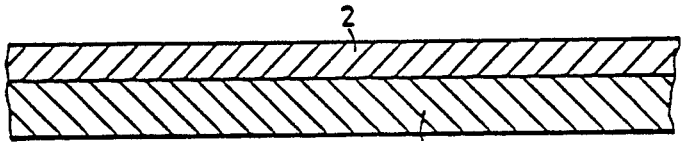
FIG. 8 is an illustration showing a straight interfacial bond.

FIG. 8 is a diagram of a magnification of an explosive welded straight or plane interface between two metal layers 2 and 4.

Figure 9:
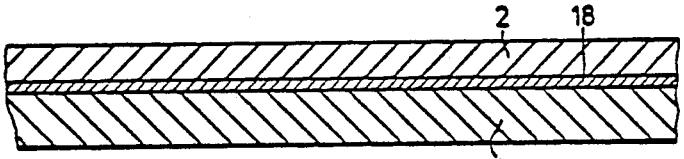
FIG. 9 is an illustration showing a uniform melted layer in which the metals are bonded together with an intervening layer of solidified melt of substantially homogeneous composition.

FIG. 9 is a diagram of a magnification of an explosion welded uniform melted layer 18 in which the metals of layers 2 and 4 are bonded together with an intervening layer of solidified melt 18 of substantially homogeneous composition.

Figure 10:
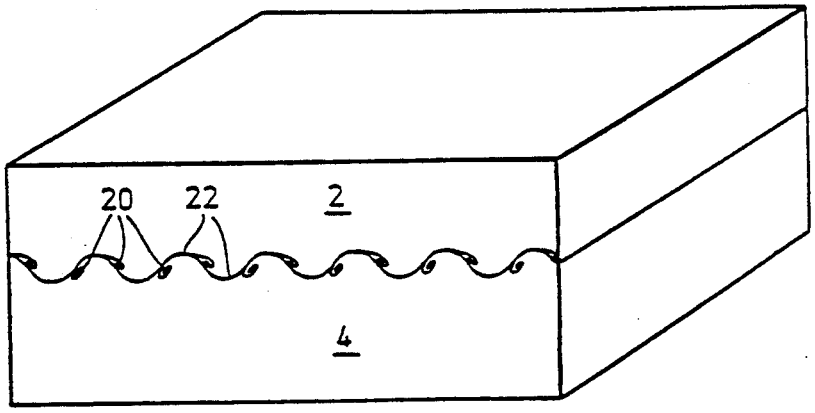
FIG. 10 is an illustration of a wavy type of bond zone for equal or similar density metals.
Figure 11:
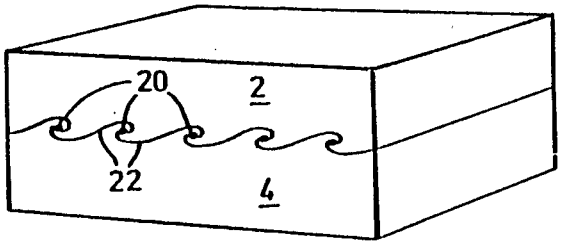
FIG. 11 is an illustration of a wavy type of bond zone for dissimilar density metals.

FIGS. 10 and 11 are diagrams of a magnification of an explosion welded wavy interface for similar and dissimilar density metals, respectively, comprised of periodically spaced discreet regions of solidified melt 20 between areas of direct metal to metal bond 22. The solidified melt 20 is created as the temperature at the vortex of each wave rises adiabatically followed by an extremely rapid cooling due to the dissipation of heat at the bulk of the metals far away from the interface.

It is believed that during such a dynamic process, the metals at their interface behave as fluids and that the characteristic interfaces illustrated in FIGS. 8 and 9 are examples of laminar and transition flow respectively and FIGS. 10 and 11 are examples of turbulent flow.

The mechanism of wave formation has been the subject of detailed study and theorization for many years. According to the fluid-like analogy the mechanism of wave formation may be described as the formation of vortices during the turbulent flow of metals at the interface. However, other models have evolved, which all could be operative during the process.

Presently those skilled in the art prefer the wavy interface, illustrated in FIGS. 10 and 11, in the belief that:

(a) such a wavy interface increases the area of surface bonding thereby creating stronger bonds;

(b) mechanical interlocking occurs between the two metal layers 2 and 4 which has been defined as a zip-like effect.

It has been found, however, that in accordance with the invention described herein superior welds are obtained for metal combinations capable of forming brittle intermetallics by producing a straight interfacial bond which contains either non-detectable or negligible diffusion zones, at the bonded interface, as illustrated in FIG. 8, rather than by the wavy bond illustrated in FIGS. 11 (which corresponds to the interfacial morphology of dissimilar metal combinations)

Welding Windows

A method shall now be described for determining those values of welding velocity and impact angle for specific metal combinations which will produce a straight interfacial bond by impact welding. Such method shall be more fully described herein but generally involves the generation of data using many values of welding velocity and impact angles and observing the type of bond resulting therefrom. The results are then plotted on a graph identified as the "Welding Window" for that particular metal combination with the welding velocity plotted on the y co-ordinate and the impact angle on the x co-ordinate.

A gas gun was utilized to generate the required data rather than an explosive because of the difficulties encountered in controlling and measuring the variables during the explosion welding process. However the data obtained from the gas gun are applicable to explosion welding.

Only a general description of the equipment and operation of the gas gun shall follow. A more detailed discussion of the gas gun utilized herein may be found in the 1977 publication of The Queen's University of Belfast, Report No. 1080 entitled "The Design and Development of a 63.5 m.m. Bore Gas Gun for Oblique Impact Experiments and Preliminary Results" by A. Szecket and B. Crossland.

Gas Gun

Figure 16:
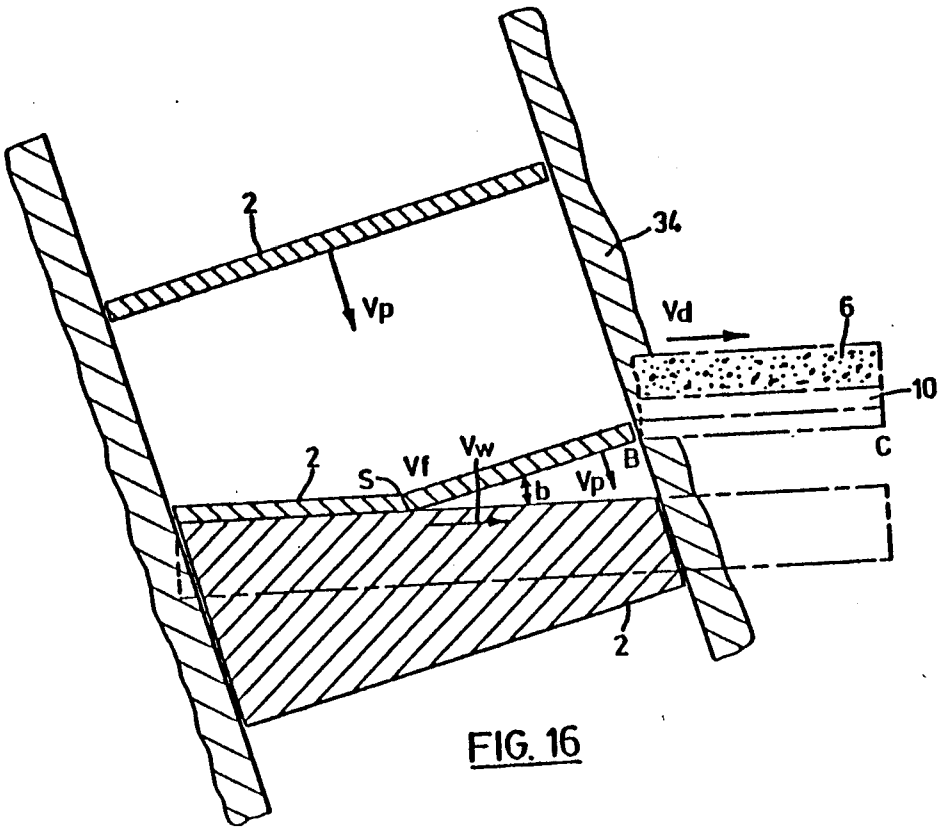
FIG. 16 is an illustration of the similarity between the bonding process by driving the flyer plate to the parent plate by a gas gun and the explosion welding process.

The similarity of the explosive welding process with the gas-gun is illustrated in FIG. 16. This similarity enables the usage of the gas-gun as a simulation system of explosive welding.

Figure 12:
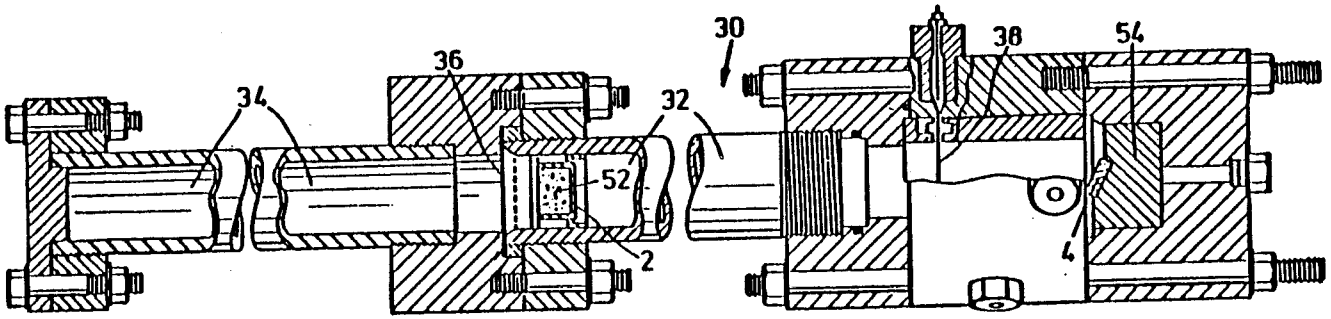
FIG. 12 is a side elevational view in section illustrating the gas gun used for impact welding.

The gas gun 30 illustrated in FIG. 12 was utilized to propel a flyer plate 2 inside the barrel 32 of the gas gun against the parent plate 4.

The gas gun 30 includes a pressure chamber or gas receiver 34, a bursting disc 36, a velocity measuring system 38 and support pad 54.

Figure 15:
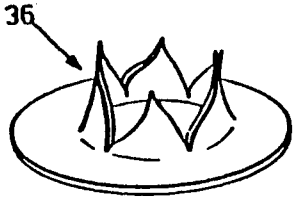
FIG. 15 is an illustration of a disc which has burst.

A compressor system (not shown) is employed to deliver a gas under pressure to the pressure chamber 34 through conducts (not shown). The pressure chamber 34 is sealed at one end thereof by a bursting disc 36 which is shown in FIGS. 13, 14 and 15.

Figure 14:
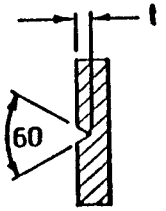
FIG. 14 is a cross-sectional view of the bursting disc taken along the line 1—1 in FIG. 13.
Figure 13:
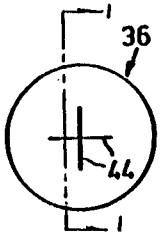
FIG. 13 is a top plan view of a bursting disc used as a diaphram to instantaneously release the gas pressure and propel a projectile towards the target in the gas gun.

As shown in FIGS. 13 and 14, the bursting disc 36 has two "V" crosscuts 44 which are scribed along one face of the bursting disc 36 at an angle of 60 degrees at various depths t. The bursting disc 36 is located between the pressure chamber 34 and barrel 32 and clamped into position. The bursting disc 36 is adapted to burst as illustrated in FIG. 15.

Initially, the bursting discs 36 is capable of withstanding the pressure buildup in pressure chamber 34. However as the pressure of gas in the pressure chamber 34 reaches a critical value which depends on the material of the bursting disc 36 and the thickness of the scribe t, the bursting disc 36 ruptures which will release the pressurized gas into the barrel 32.

The flyer plate 2 in the gas gun is carried by a sabot 52 as shown in FIG. 12. The sabot 52 is made of lightweight material and adapted to carry the flyer plate 2 by means of a double sided adhesive tape or adhesive.

As the bursting disc 36 bursts, the pressure of the gas is released into the barrel 34 which propels or drives the sabot 52 with the flyer plate 2 towards the parent plate 4, at an impact velocity Vp. By utilizing bursting disc 36 of different materials, thicknesses and different thicknesses of scribe t, the pressure at which the disc 36 bursts may be controlled; and hence the impact velocity Vp of the flyer plate 2 may be measured.

The sabot 52 is completely destroyed upon impact of the flyer plate 2 with the parent plate 4.

The parent plate 4 is held in an oblique mounting pad 54 as illustrated in FIG. 12. The mounting pad 54 is machined to give a particular value of angle of impact h. By using mounting pad 54 having different impact angles b, the angle of impact may be controlled.

The velocity Vp of the sabot 52 is measured electronically by a variety of methods which are well known to those skilled in the art and will therefore not be described herein.

By knowing the impact velocity Vp and the angle of impact b, it is possible to calculate the welding velocity Vw along the parent plate 4 in accordance with the formulas referred to earlier. This is possible because of the similarity of the welding process which occurs with the gas gun 30 and explosion welding as illustrated in FIG. 16.

The actual value of the welding velocity Vw may also bemeasured electronically by methods well known to those skilled in the art.

The actual measured welding velocity Vw compared favourably with the calculated welding velocity Vw in accordance with the formulas outlined above.

Material Utilized for Flyer and Parent Plate in the Gas Gun

The gas-gun is a tool for the systematic study of the weldability between similar and dissimilar metals. The window described here corresponds to a particular metal combination. Accordingly, it should be understood that the gas-gun is not limited to that particular metal combination.

The material utilized in the gas gun 30 for the flyer plate 2 and parent plate 4 was copper in two different thicknesses, namely 1.58 mm for the flyer plate 2 and 10 mm for the parent plate 4, both in the half hard condition. According to BS 899 which is the designation for the raw material and Bs 1036 (C101) which applies to an electrolitic tough pitch high conductivity copper, rolled according to BS 2870/4, the chemical composition for both thicknesses was as follows:

| Cu | Pb | Bi | Other Impurities (exluding oxygen) |
|---|---|---|---|
| 99.9% | 0.005% | 0.001% | 0.03% |

Operation of Gas Gun in Impact Welding Half Hard Copper to Half Hard Copper

In impact welding half hard copper to half hard copper, a range of angle support pads 54 were utilized in the gas gun 30. The angle of impact b was preset for the particular angle support pad 54 which was utilized in the gas gun.

Similarly a range of bursting discs 36 of a particular metal and particular scribe thickness t were utilized to produce an impact velocity Vp of the flyer plate 2, and hence a particular welding velocity Vw along the parent plate 4.

Flyer plate 2 and parent plate 4 were cut from their respective copper sheets and machined to size. The flyer plate 2 was machined to 38 by 36 by 1.58 mm and the parent plate was machined to 40 by 40 by 10 mm.

The surfaces of the flyer plate 2 and parent plate 4 to be impacted were prepared by thoroughly cleaning them with a 400 grade emery paper and subsequently degreasing with acetone.

The parent plate 4 was located in the support pad 54 by means of a quick curing araldite adhesive, while the flyer plate 2 was mounted centrally on the sabot 52 by a double sided tape.

The sabot 52 was introduced into the barrel 34.

The relative alignment of the flyer plate 2 and the parent plate 4 was accomplished by a thin strip of adhesive tape fixed diametrically across the back of the sabot 52.

After locating the bursting discs 36, the gas gun 30 was assembled.

After firing, the gun 30 the welded composite comprising of half hard copper flyer plate 2 welded to the half hard copper parent plate was removed from the gas gun. A visual inspection of the welded composite was carried out to see if a weld had occurred. If a weld occurred, the specimen was sectioned and subsequently it was faced on a central lathe. If the weld withstood these fairly severe machining operations, the specimen was polished, and etched in an alcoholic ferric chloride solution for metallurgical examination, and micrograph photography.

The micrograph of the metal composite was examined to see and measure the weld morphology. This procedure was repeated for each welded composite produced with the different values of welding velocity impact angle, wave lengths, wave amplitudes or a straight interfacial bond evaluation.

Results

Figure 17:
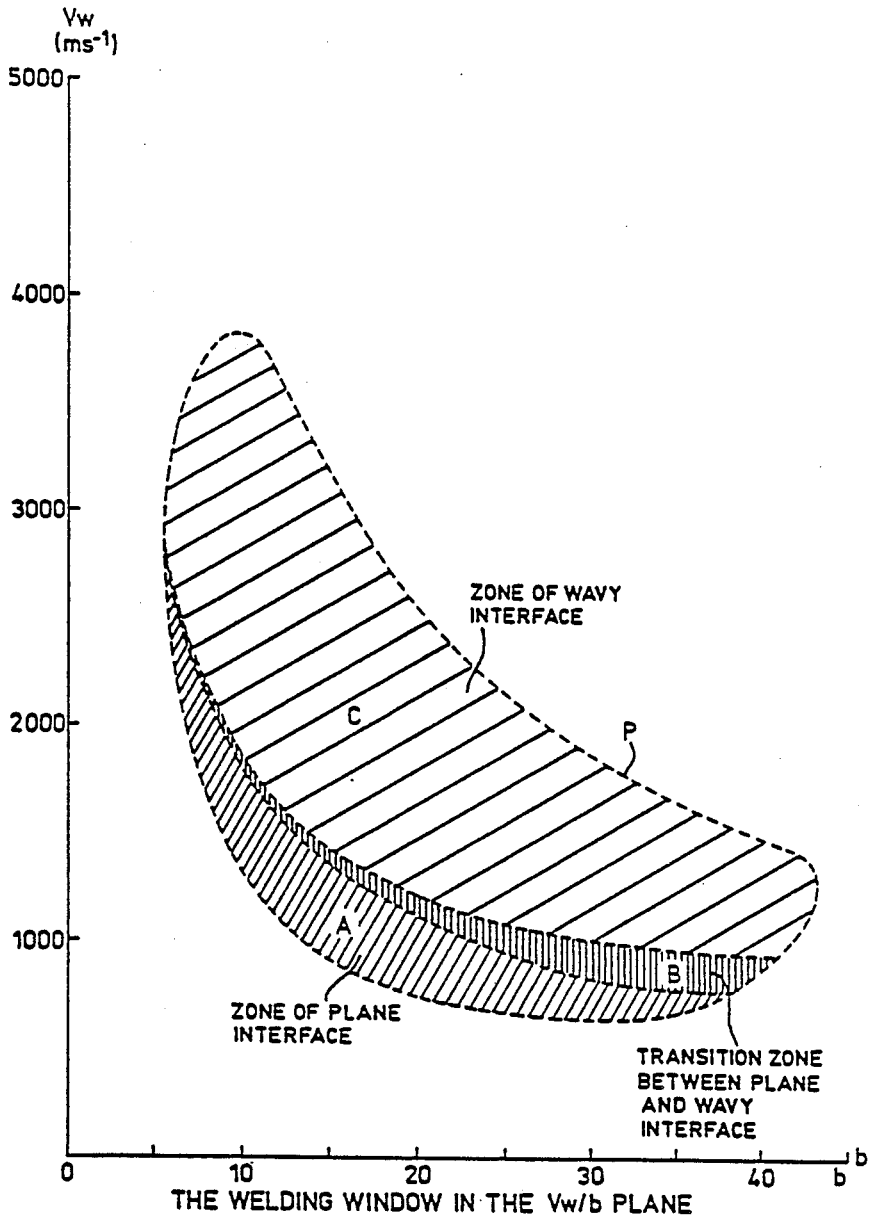
FIG. 17 is a graph of the welding window for the bonding of half hard copper to half hard copper along the welding velocity and impact angle.

Each of the specimens were visually observed as described above and plotted on the graph illustrated in FIG. 17 in a manner which may be best described by referring to the following examples relating to the bonding of half hard copper to half hard copper.

Example 1: By impact welding with a welding velocity of 3,000 meters per second and impact angle of 10 degrees the micrograph of the resulting welded composite showed a wavy interface with front and rear vortex much like that illustrated in FIG. 10.

Example 2: By impact welding, with a welding velocity of 2,000 meters per second and impact angle of 20 degrees the micrograph of the resulting welded composite showed a wavy interface much like the one illustrated in FIG. 10.

Example 3: By impact welding with a welding velocity of 1,500 meters per second and impact angle of 10 degrees the micrograph showed a straight waveless interface like the one illustrated in FIG. 8.

Example 4: By impact welding with a welding velocity of 1,000 meters per second and impact angle of 20 degrees the micrograph of the resulting welded composite showed a straight waveless interfacial bond as illustrated in FIG. 8.

Example 5: By impact welding with a welding velocity of 1,000 meters per second and impact angle of 25 degrees the micrograph of the resulting welded composite showed an interface which exhibited portions of irregular wavy interface and straight interface.

Example 6: By impact welding with a welding velocity of 1,500 meters per second and impact angle of 25 degrees the micrograph of the resulting welded composite showed a wavy interface with a single vortex like that illustrated in FIG. 11.

The results of the impact welding including the examples described above were plotted on a graph with welding velocity on the y axis and impact angle on the x axis.

After plotting the results on the graph, it was possible to define;

(a) zone A in which all of the specimens had a straight interface in the region of contact;

(b) zone B in which irregular waves together with portions of straight bonds could be detected at the interface;

(c) zone C in which all of the specimens had a wavy interface in the region of contact. However this region presents two different wave morphologies depending on the impact parameters, namely an interface like that illustrated in FIG. 10 with front and rear vortex which corresponds to similar density explosive welds and an interface like that illustrate in FIG. 11 with a single vortex which corresponds to dissimilar density explosive welds.

Generally, specimens lying outside of the periphery P of the welding window had incomplete or no bonding between layers. More specifically, below the lower velocity boundary over the whole range of impact angles partial or poor bonds or no bonds were formed, the interface being characterized by trapped surface contaminants and the presence of voids particularly at lower values of b. The upper velocity limit was characterized by the presence of excessive melting.

The welding window of FIG. 17 for half hard copper to half hard copper provides all of the interfacial geometries experienced in the explosive welding process.

By controlling the welding velocity Vw and impact angle b to:

(a) fall within the zone of plain interfacial weld; a straight interfacial bond is produced along the common interfacial region of contact between the plates;

(b) fall in the transition zone, an interface having irregular waves together with portions of straight interface may be produced; and (c) fall within the zone of wavy interface, a wavy interface is produced along the common interfacial region of contact.

Thickness of Flyer and Parent Plates in the Gas Gun

As referred to earlier the thickness of the flyer plate and parent plate utilized in the gas gun was 1.58 mm and 10 mm respectively. If a thicker flyer plate is used the upper boundary illustrated in Figure 17 would come down or in other words be displaced downwardly toward the x axis due to the creation of excessive melt as a result of the difficulty in dissipating heat with higher kinetic energies. On the other hand the right hand boundary illustrated in FIG. 17 would move closer to the y axis as this limit boundary is related to the rigidity of the flyer plate. The other boundaries in FIG. 17 would remain substantially constant.

Accordingly the thickness of the plates utilized in the gas gun will have a bearing on the relative shape or boundary of the welding window plotted for a particular metal combination which is impact welded together.

Different Metal Combinations

Although FIG. 17 illustrates the welding window for the bonding of half hard copper to half hard copper, similar welding windows may be constructed for different metal combinations, when impact welding or explosion welding different metals of flyer plate 2 and parent plate 4.

Table 1 illustrates metal combinations which have been successfully bonded by means of explosion, and accordingly welding windows may be developed for the metal combinations outlined in Table 1.

The parameters of the impact welded or explosion welded joint may be controlled so as to select the angle of impact b between the flyer plate 2 and parent plate 4 and to select the velocity Vw of progressively obliquely impacting the plates along each other so as to produce a straight interfacial bond.

For example, it has been found that a straight interfacial bond is consistently produced between the explosion welding of aluminum 1100 to half hard copper by having:

(a) a welding velocity Vm of 1,850 meters per second; and (b) an impact angle of 12 degrees.

Furthermore, a straight interfacial bond is consistently produced between the explosion welding of aluminum 1,100 to low carbon steel with up to 0.20 percent carbon (i.e. up to AISI C1020 or equivalent) by having:

(a) welding velocity Vw of 1,750 meters per second; and (b) an impact angle of 16 degrees.

Moreover, a straight interfacial bond is consistently produced between the explosion welding of half-hard copper to titanium 35 A by having:

(a) a welding velocity of Vw of 2,200 meters per second; and (b) an impact angle of 11 degrees.

The values for Vw and b given for the impact welding of aluminum 1100 to half hard copper, aluminum 1100 to low carbon steel, and half-hard copper to titanium to produce a straight interfacial bond are not to be interpreted as limiting, as welding windows similar to FIG. 17 may be constructed for these metal combinations as well as for other metal combinations having a range of Vw and b falling within the zone of plane interface. Any value of Vw and b falling within the zone of plane interface will produce a bond having a straight interface.

It will be understood to those skilled in the art that in explosion welding, the welding velocity Vw and the impact angle may be controlled by employing a suitable explosive and selecting the stand-off between the plates.

The straight interfacial welded bond between:

(a) aluminum 1100 to half hard copper;

(b) aluminum 1100 to low carbon steel having up to 0.20 percent of carbon;

(c) half-hard copper to titanium 35 A. contained no detectable diffusion zone and thus no detectable brittle intermetallic phases even though these metal combinations tend to form metastable phases. There was no detectable intermixing of aluminium to copper or aluminum to steel or copper to titanium respectively at the bonded interface, and thus no intermetallic formation could be delineated for the straight interfacial bond.

The Straight Waveless Interface

Figure 21:
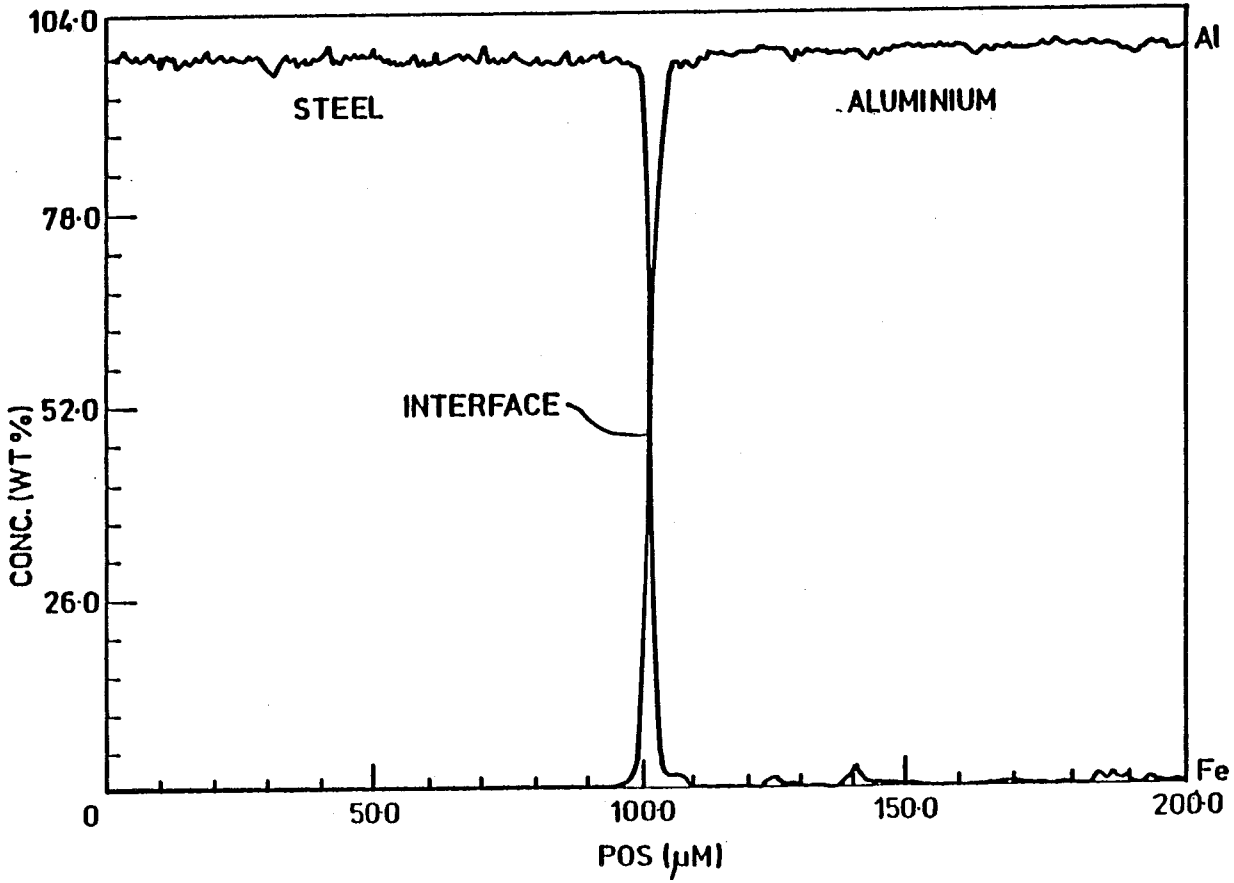
FIG. 21 is a diffusion profile of the relative concentrations of aluminum into steel and vice versa at various positions from the interface of a straight explosion bond between aluminum and steel.

FIG. 21 is a diffusion profile of the relative concentrations of aluminum into steel and vice versa at various positions from the interface of a straight waveless explosion bond between aluminum and steel. FIG. 21 was prepared by focusing a micro beam on the interface and reading the relative compositions of aluminum and steel at various distances from the interfaces. The resulting graph shows a negligible amount of diffusion at the substantially straight waveless interfacial bond.

Strength of Straight Waveless Interface

Figure 18:
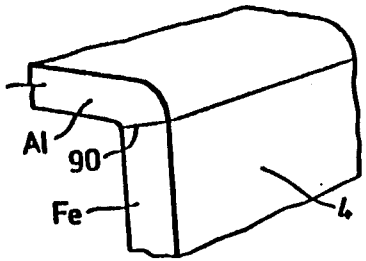
FIG. 18 is a perspective view illustrating a bonded joint of aluminum to steel having a straight interface, before and after bending of 90 degrees.
Figure 19:
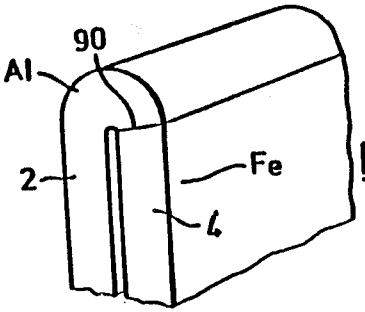
FIG. 19 is a perspective view illustrating a bonded joint of aluminum to steel having a straight waveless interface, which has been bent 180 degrees.
Figure 20:
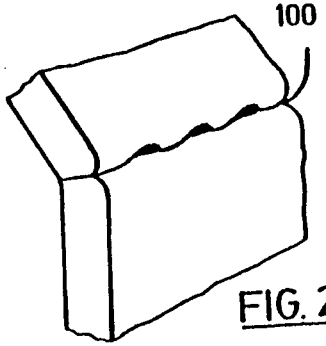
FIG. 20 shows a view of a bonded joint of aluminum to steel having a wavy interface, after bending.

Metal plates which tend to form brittle intermetallics in the bonded region and which metal plates have been bonded together by driving the flyer plate 2 against the parent plate 4 so as to produce a straight interfacial bond in the region of contact exhibit superior strength characteristics over bonds exhibiting wavy interfaces upon bending of the plates 2 and 4 about the bonded region as illustrated in FIGS. 18, 19 and 20.

FIG. 18 illustrates bonding of two different metal layers 2 and 4 having a straight interface 90; namely aluminum for metal layer 2 and low carbon steel having up to 0.20 percent carbon steel for metal layer 4. The phantom lines in FIG. 18 illustrate the metal joint before bending. After bending, both statically and dynamically (such as heavily hammered), the metal layer 2 about the straight interface at 90 degrees and 180 degrees as illustrated in FIGS. 18 and 19 respectively, the aluminum layer 2 "stretches" without tearing about the straight interfacial bond. There was no separation at the interface although striations were observed on the surface of the aluminum.

However, a static bend of less than 90 degrees applied to bonded metals having a wavy interface produces a discreet distribution of fractures 100 of the interface at each vortex zone, as illustrated in FIG. 20.

When the low carbon steel layer 4 contained an amount of carbon above 0.20 percent carbon (i.e. above AISI C1020 or equivalent) a small amount of intermetallics became perceptible at X 400 magnification at the straight interfacial bond. However the welded product was still substantially better than the wave-like morphology as there was no tearing about the straight interfacial bond after subjecting the welded joint to a 90 degree and 180 degree bend (both static and dynamic) as illustrated in FIGS. 18 and 19 respectively.

The melt associated with the wavy interface present zones of weakness or inherent weld defects which fracture when subjected to bending and other excessive exterior solicitations.

Hence, explosion welded joints having straight waveless interfaces have superior strength characteristics over wavy interfaces for metal combinations capable of developing brittle intermetallics.

Straight Interfacial Bonds Exposed to Elevated Temperatures

Metal plates characterized as tending to form brittle intermetallics and which have been bonded together by driving the flyer plate 2 against the parent plate 4 so as to produce a straight interfacial bond in the region of contact exhibit improved strength characteristics after prolonged exposure to service temperatures. For example the service temperature of an explosively welded aluminum to low carbon steel transition joint utilized in an aluminum reduction cell would be in the vicinity of about 300 to 400 degrees centigrade.

Yet a bonded zone of aluminum 1,100 to low carbon steel (with up to 0.20 percent carbon steel) having a straight interface which was produced by:

(a) selecting the welding velocity Vw at 1,750 meters per second; and (b) an impact angle of 16 degrees; was exposed to:

(i) a temperature of 480 degrees C. for six hours and showed no detectable intermetallic formation;

(ii) a temperature of 500 degrees C. for three ours and showed no detectable intermetallic formation; and (iii) a temperature of 520 degrees C. for three hours with no detectable intermetallic formation.

By utilizing the invention disclosed herein, aluminum to steel bonds are produced having a straight interface with substantially no melt or intermetallics. Furthermore, there were no intermetallic formations which could be observed by subjecting the bonded aluminum to steel straight interface to the temperatures and length of time referred to above. It is believed that this occurs because of the absence of melt in the straight interface bond, and therefore the diffusion process which leads to intermetallics is retarded.

Application of Impact Welded Joints

The impact welded product having a straight interfacial bond has many industrial applications. For example:

(a) titanium to steel, or aluminum to steel, or zircalloy to inconnel joints. The zircalloy to inconnel joint may be used in pressurized water reactors due to the favourable thermal neutron adsorption cross-sections and high resistance to corrosion.

(b) aluminum to stainless steel joints of tubes used in cryogenics.

(c) in aluminum smelters, the anode and cathode are jointed to the electric bus bars by means of an aluminum to steel transition joint.

WAVY VS STRAIGHT BOND

For greater particularity, it is apparent to those persons skilled in the art that:

(A) WAVY INTERFACE (i) the term Wavy Interface refers to the wavy interface generated in the direction parallel to the direction of detonation, (ii) a straight interface may be observable in a direction perpendicular to the direction of detonation, as illustrated in FIGS. 10 and 11, although it is more likely that a wavy interface will be seen having a lower frequency than the frequency of the waves generated in the direction of detonation.

(B) STRAIGHT INTERFACE (i) the term straight interface refers to the straight interface generated in the direction parallel to the direction of detonation, (ii) a straight interface will also be observable in a direction perpendicular to the direction of detonation.

STRAIGHT INTERFACE AND HOLLOW CHARGE

It is well known that by hollowing an explosive charge and detonating same, the explosive force is converged onto a small area. By lining the hollow in the explosive charge with a metal liner, and detonating same, the explosive collapses the metallic liner into a slug and a high-speed metal jet which can perforate armor plate. Thus, the shaped charge phenomena has given rise to the development of a number of devastating weapons such as the bazooka.

Figure 22:
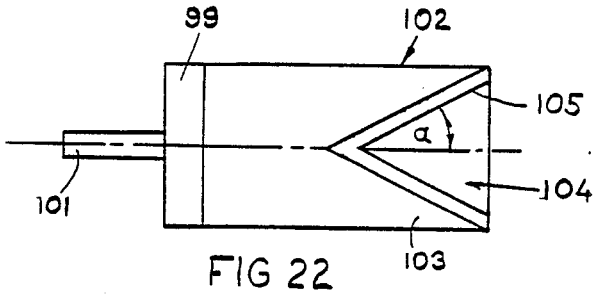
FIG. 22 is a cross-section of a hollow charge with a conical shaped liner prior to detonation.

FIG. 22 shows in cross-section, a hollow charge 102 of cylindrical cross-section. The hollow charge 102 comprises of explosive charge 103, a detonator 101, a booster 99, a coned shaped hollow 104, and metal liner 105. The coned shaped hollow 104 has an angle a between the axis of the cylinder and walls of the coned shaped metal liner 105.

Figure 23:
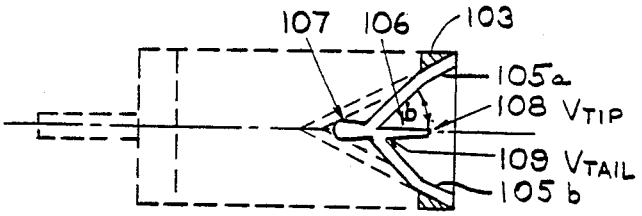
FIG. 23 is a cross-section of a hollow charge with a conical shaped liner an instant following the detonation.

FIG. 23 shows the hollow charge 102 an instant following detonation. The detonation of the explosive 103 along the metal liner 105 drives the metal liner walls 105*a* and 105*b* progressively into collision with each other to form a metal jet 106 and a slug 107.

It is evident that a similarity exists between the detonation of the hollow charge as depicted in FIG. 23 and the explosion welding as depicted in FIG. 2. However, the objective in the hollow charge is to maximize the metal jet 106, while the objective in explosive welding is to maximize the slug (which is the "product") and minimize the jet which serves only as a decontaminating mechanism.

Figure 24:
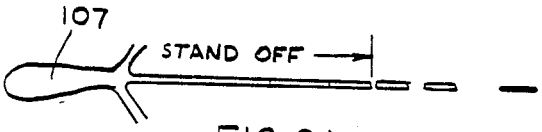
FIG. 24 is a view of the metal jet formed by the detonation of a hollow charge just at the point of breaking up, so as to determine the stand-off.

The linear collapse produces a continuous jet 106 with a velocity gradient. The tip of the jet 108 travels at a high velocity $V_{TIP}$, and the velocity decreases toward the tail of the jet 109 with a velocity $V_{TAIL}$. This velocity gradient causes the jet 106 to stretch until it breaks into segments 110 as shown in FIG. 24. The penetration capability decreases as the jet breaks. The distance between the tip 106 and the operator is called the stand-off. It is an object to maximize the stand-off up to the point where the tip begins to break.

In one particular example of a hollow charge lined with copper, the tail velocity $V_{TAIL}$ may reach values of 3,000 meters/second while the tip velocity $V_{TIP}$ may reach values as high as 8–10 km/second. The stagnation pressure due to a $V_{TIP}$ of 8–10 km/second greatly exceed the ultimate tensile strength of conventional armor, and therefore, the metal jet 106 is capable of penetrating such armor.

It is well known that the penetration capability of the metal jet 108 is proportional to the square root of the density of the metal liner 105. Therefore, heavy metals having relatively larger densities, such as gold or tantalum are found to be more effective.

It is also known that only a minor part of the conical liner 105 actually contributes to the metal jet 106 and the attendant penetration process, while the remainder of the liner 105 forms the slug 107.

Figure 25:
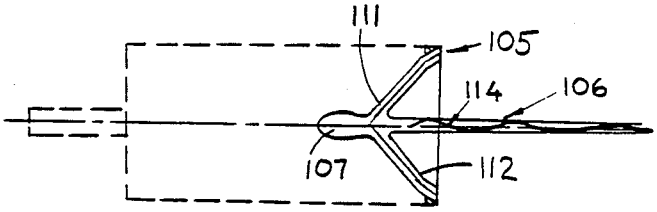
FIG. 25 is a view of the hollow charge with a bimetal liner an instant following the detonation.

Therefore, bi-metal liners have been produced, as shown in FIG. 25, whereby an inexpensive low-density metal 111, such as copper, is utilized for the rear side of the metal liner 105 in contact with the explosive, which will eventually form the slug; and a relatively expensive high-density metal 112, such as tantalum, utilized in the front side for the eventual formation of the metal jet 106 for a more effective penetration.

The bi-metal liners 105 have been only recently joined together, for example by:

(a) mechanical clamping of metal liners 111–112, or (b) electro plating one of the layers 111 to the other layer 112.

However, upon detonation of the hollow charge, reflection waves will appear due to the difference in the accoustic impedance between the joined metals 111 and 112 which may cause destruction of the entire assembly, before the jet is formed. Both mechanical clamping or electroplating create poor attachment strengths.

$$\text{Accoustic Impedance} = \text{Density of Metal} \times \text{Sonic Velocity of Metal}$$

It has been found that an explosively welded bimetal liner 105 between the low-density material 111 and the high-density material 112, gives an excellent attachment strength which withstands the stressing due to the above mentioned reflections.

On the other hand, the coherency of the jet 106 is extremely sensitive with the surface finishing of the cone, or hemisphere.

Moreover, there is a built-in instability which is characteristic of this phenomenon, that is a pulsating pressure 114 originating at the impact-point 113, which will eventually manifest itself by causing the breakage of the tip of the jet. It is believed that this instability is enhanced by the surface roughness; which means that the superficial asperites, voids, and microdefects behave under the explosive load as "microbazookas"; i.e. sources of microjetting which could deviate the main jet from its coherency.

Prior to the invention described herein explosive welding was usually associated with a wavy interface between the two metal-layers.

Thus, if the high density metal 112 while jetting encounters the wavy type bond, the aforementioned instability will be increased; thus limiting the stand-off.

If the explosively welded interface between the low density metal 111 and the high density metal 112 is substantially waveless, the inherent instability generated by the system is minimized and thereby the stand-off could be increased.

Parameters, such as welding velocity and impact angle, for producing explosion welded liners having substantially waveless interfacial bond, may be determined by the simulation system of the explosion welding process, namely, the gas gun which produces an impact weld, between any particular metal combination.

Figure 26:
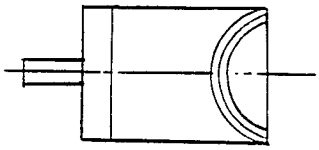
FIG. 26 is a cross-section view of a hemispherically shaped hollow charge with a bi-metal liner.

The hollow charge 102 may have a metal liner 105 shaped like a cone as described in FIGS. 22 and 23, or any other shape such as a hemisphere as shown in FIG. 26.

The hemispherical shape can be utilized to produce a metallic jet 106 having substantially no slug 107.

The metal liner 105 may be formed by explosive forming, in the manner well known to those in the art.

The potential achievable range of velocities for $V_{TIP}$ and $V_{TAIL}$ for metal jets developed by conical liners and hemispherical liners are as follows:

For the Conical Liner $V_{TIP}$=7–10 km/second $V_{TAIL}$=2–4 km/second

For the Hemispherical liner $V_{TIP}$=4–6 km/second $V_{TAIL}$=1.5–3 km/second

The penetration characteristics of the hollow charge are a function of the ratio defined as:

$$(V_{TIP})/V_{TAIL}$$

The greater the ratio the better the penetration characteristics of the jet. In this regard, the penetration ratio may be increased by either increasing $V_{TIP}$ or decreasing $V_{TAIL}$, or both.

By utilizing a hollow charge having a metal liner comprising of at least two metal layers which have been metallurgically bonded by explosion welding and having a substantially waveless interfacial bond therebetween, either the $V_{TIP}$ of the jet may be increased closer to the maximum potential achievable range as outlined above, or the $V_{TAIL}$ of the jet may be decreased closer to the minimum potential achievable range as outlined above, or both; thereby increasing the $V_{TIP}/V_{TAIL}$ ratio, and improving the penetration capabilities of the hollow charge.

Although the preferred embodiments as well as the operation and use have been specifically described in relation to the Drawings, it should be understood that variations in the preferred embodiments could easily be achieved by a skilled man in the trade without departing from the spirit of the invention. Accordingly, the invention should not be understood to be limited to the exact form revealed in the Drawings.

The embodiment of the invention in which an exclusive property or privilege is claimed are defined as follows:

1. In the process for metallurgically bonding two layers of metal capable of forming brittle intermetallics by means of propelling one of said layers progressively into collision along said other layer, the improvement comprising; selecting the velocity and impact angle so as to produce a waveless complete metal to metal bond substantially free of the formation of brittle intermetallics along the entire interfacial region of contact between said layers.

2. The process of claim 1 wherein said metal layers are selected from the group of metals comprising of steel, stainless steel, aluminum, copper, nickel, titanium, zirconium, gold, silver, platinum, columbium, molybdenum, magnesium, chromium,tunsten, paladium, zinc, and their respective alloys.

3. The process of claim 2 wherein said angle has a value between six degrees and forty-one degrees.

4. The process of claim 3 wherein said velocity is selected from a value between six hundred and fifty meters per second and two thousand seven hundred meters per second.

5. The process of claim 1 wherein one of said layers is comprised of aluminum 1100 and said other layer is comprised of half hard copper.

6. The process of claim 5 wherein said velocity is selected at about 1850 meters per second and said impact angle is selected at about 12 degrees.

7. The process of claim 1 wherein one of said layers is comprised of aluminum 1100 and said other layer is comprised of low carbon steel having up to 0.20 percent of carbon.

8. The process of claim 1 wherein said velocity is selected at about 1750 meters per second and said impact angle is selected at about 16 degrees.

9. The process of claim 1 wherein one of said layers is comprised by half-hard copper and said other layer is comprised of titanium A 35.

10. The process of claim 9 where said velocity is selected at about 2,200 meters per second and said impact angle is selected at about 11 degrees.

11. The process of claims 6, 8, or 10 wherein said propelling means comprises propelling said layers together with an explosive.

12. In the method of explosion welding two metal layers together along a common interfacial region of contact, wherein said layers are characterized as capable of forming brittle intermetallics, said method comprising:

(a) positioning said layers in generally spaced apart relation;

(b) applying a layer of explosive charge adjacent the outer surface of one or both of said layers remote from said other layer;

(c) detonating said explosive charge so as to weld said layers together, the improvement which comprises selecting both the strength of explosive charge and the spacing between said layers so as to propel onen of said layers progressively into collision along said other layer at a velocity and impact angle selected to produce a waveless, complete metal to metal bond substantially free of the formation of brittle intermetallics along the entire interfacial region of contact between said layers after detonation of said charge.

13. The method of claim 12 wherein a layer of protective material is applied to the outer surface of one or both of said layers remote from said other plate and then applying said layer of explosive charge upon said protective material.

14. The method of claim 13 wherein said layers are positioned in generally spaced parallel relation.

15. The method of claim 13 wherein said layers are positioned in inclined relation to one another.

16. In a method for metallurgically bonding two metal layers together along a common interfacial region of contact, wherein said metal layers are characterized as capable of forming brittle intermetallics, said method comprising:

(a) positioning said layers in generally spaced apart parallel relation;

(b) applying a protective material adjacent the outer surface of one or both of said layers remote from said other layer;

(c) applying a layer of explosive charge upon said protective material;

(d) detonating said explosive charge so as to produce a welded bond, the improvement which comprises selecting both the strength of explosive charge and the spacing between said layers so as to propel one of said layers progressively into collision along said other layer at a velocity and impact angle selected to produce laminar flow of the metal layers at the interface during detonation of said explosive charge and produce a welded bond having a waveless complete metal to metal interfacial bond substantially free of the formation of brittle intermetallics along the entire interfacial region of contact between said layers.

17. The improved method of claim 16 wherein said metal layers are selected from the group of metals comprising steel, stainless steel, aluminum, copper, nickel, titanium, zirconium, gold, silver, platinum, columbium, molybdenum, magnesium, chromium, tungsten, paladium, zinc, and their respective alloys.

18. In a method of producing bonded metal layers having improved strength characteristics in spite of a prolonged exposure to elevated temperatures wherein said metal layers are characterized as capable of forming brittle intermetallics, said method comprising; propelling one of said layers against the other to obliquely impact the layers together at a velocity and impact angle selected to produce a waveless complete metal to metal bond substantially free of the formation of brittle intermetallics along the entire interfacial region of contact between said layers.

* * * * *